US007426800B2

(12) United States Patent
Pierce et al.

(10) Patent No.: US 7,426,800 B2
(45) Date of Patent: Sep. 23, 2008

(54) STABILIZATION DEVICE

(76) Inventors: Rodney W. Pierce, 2575 NE. Kathryn St., Suite 26, Hillsboro, OR (US) 97124; Michael R. Fox, 2575 NE. Kathryn St., Suite 26, Hillsboro, OR (US) 97124

( * ) Notice: Subject to any disclaimer, the term of this patent is extended or adjusted under 35 U.S.C. 154(b) by 169 days.

(21) Appl. No.: 11/317,657

(22) Filed: Dec. 22, 2005

(65) Prior Publication Data

US 2006/0248774 A1 Nov. 9, 2006

Related U.S. Application Data

(60) Provisional application No. 60/638,647, filed on Dec. 22, 2004.

(51) Int. Cl.
*F41C 27/00* (2006.01)

(52) U.S. Cl. ..... 42/94; 89/37.04; 248/166; 248/169; 248/171

(58) Field of Classification Search ..... 42/94; 89/37.04; 248/165, 166, 168, 169, 170, 171, 248/177.1

See application file for complete search history.

(56) References Cited

U.S. PATENT DOCUMENTS

| | | | | |
|---|---|---|---|---|
| 2,472,804 | A * | 6/1949 | Bird | 89/37.01 |
| 5,074,188 | A | 12/1991 | Harris | |
| 5,390,885 | A | 2/1995 | Shen | |
| 5,749,549 | A * | 5/1998 | Ashjaee | 248/168 |
| 5,815,974 | A | 10/1998 | Keng | |
| 6,487,807 | B1 | 12/2002 | Kopman et al. | |
| 6,663,071 | B2 | 12/2003 | Peterson | |
| 6,763,627 | B1 | 7/2004 | Kaempe | |

FOREIGN PATENT DOCUMENTS

EP 127193 A1 * 12/1984

* cited by examiner

*Primary Examiner*—Michael J. Carone
*Assistant Examiner*—Gabriel J Klein
(74) *Attorney, Agent, or Firm*—Kolisch Hartwell P.C.

(57) ABSTRACT

An apparatus and a system for a stabilization device are disclosed herein.

9 Claims, 5 Drawing Sheets

STABILIZATION DEVICE

RELATED APPLICATION

This application claims priority to U.S. Provisional Patent Application No. 60/638,647 filed on Dec. 22, 2004, and entitled "STABILIZATION DEVICE".

FIELD

Embodiments of the invention relate generally to the field of firearms, and more particularly to a stabilization device for providing stability to such a firearm.

BACKGROUND

Discharge of a firearm is done at a distance from the operator along the operator's line of sight. The distance may be due to the extension of operator's arms (e.g., when the firearm is a pistol) or to the elongated nature of the firearm (e.g., when the firearm is a rifle). Accuracy in discharging the firearm requires that the distal end of the firearm be held steady for a period of time to aim and subsequently discharge the firearm. The steadiness required during the aiming and discharge of the firearm usually requires auxiliary support for sufficient stabilization.

Bipods have been attached to the firearm in an attempt to provide portable stabilization for the discharging of the firearm. Some of these prior art bipods have legs that transition between a stored state, with the legs next to the barrel of the firearm, and a deployed state, with the legs rotated away from the barrel so that the firearm can rest on a surface via the legs. These prior art bipods typically rely on externally exposed springs to deploy the legs. These external springs may present difficulties due to use of the bipod in a variety of environmental conditions. For example, an external spring may corrode due to moisture exposure or it could be trapped or bent by debris. Additionally, prior art bipods are bulky, even in the stored state, and provide a considerable increase to the overall dimensions and weight of the combined firearm/bipod.

BRIEF DESCRIPTION OF THE DRAWINGS

Embodiments of the invention are illustrated by way of example and not by way of limitation in the figures of the accompanying drawings, in which like references indicate similar elements and in which.

DETAILED DESCRIPTION

Various embodiments of the invention may provide for a stabilization device capable of quick and dependable deployment for the stabilization of a firearm coupled thereto.

Various aspects of the illustrative embodiments will be described using terms commonly employed by those skilled in the art to convey the substance of their work to others skilled in the art. However, it will be apparent to those skilled in the art that alternate embodiments may be practiced with only some of the described aspects. For purposes of explanation, specific materials and configurations are set forth in order to provide a thorough understanding of the illustrative embodiments. However, it will be apparent to one skilled in the art that alternate embodiments may be practiced without the specific details. In other instances, well-known features are omitted or simplified in order not to obscure the illustrative embodiments.

Further, various operations will be described as multiple discrete operations, in turn, in a manner that is most helpful in understanding the present invention; however, the order of description should not be construed as to imply that these operations are necessarily order dependent. In particular, these operations need not be performed in the order of presentation.

The phrase "in one embodiment" is used repeatedly. The phrase generally does not refer to the same embodiment; however, it may. The terms "comprising," "having," and "including" are synonymous, unless the context dictates otherwise.

Figure 1:
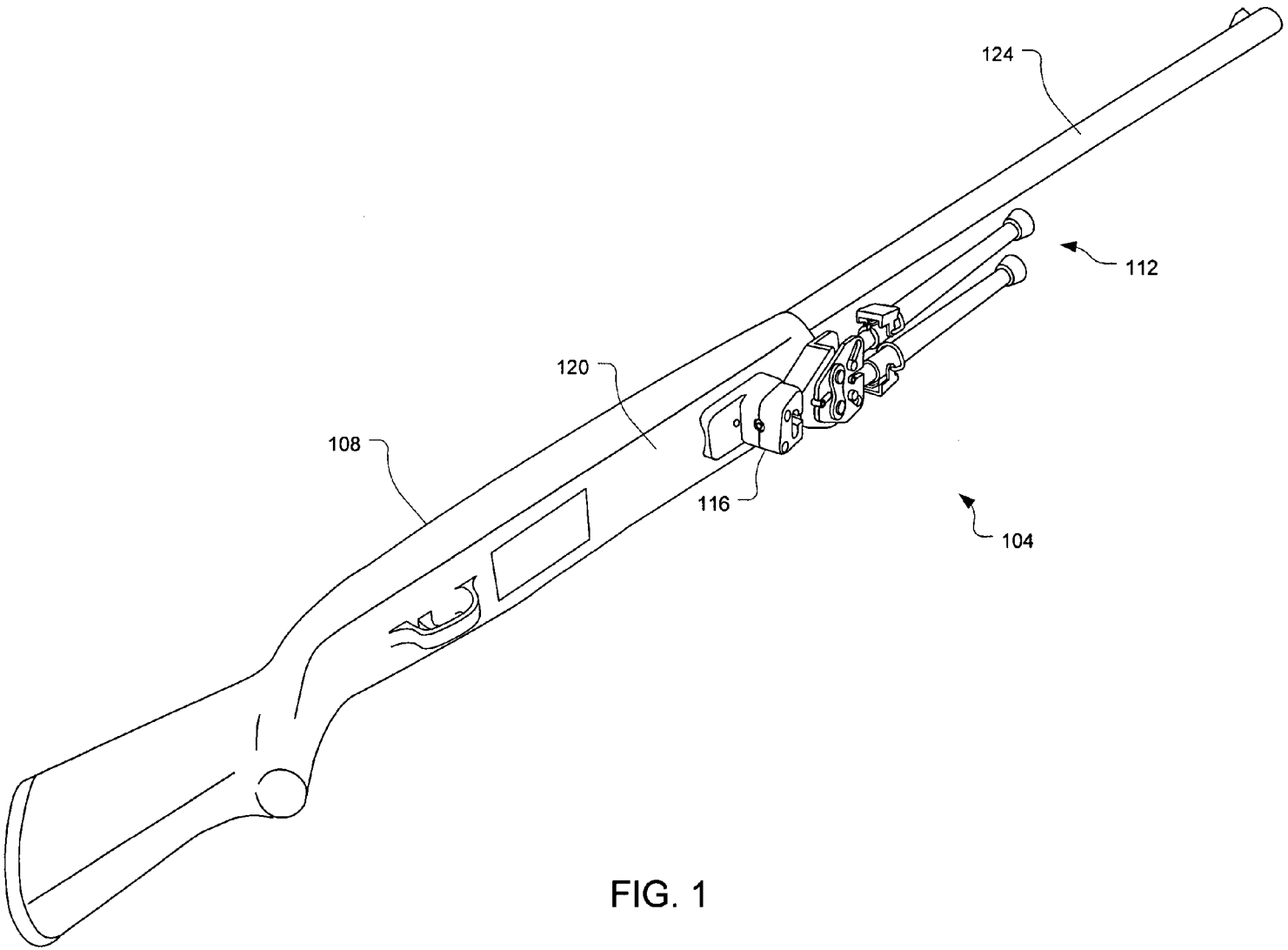
FIG. 1 illustrates a perspective view of a system including a firearm coupled with a stabilization device in a stored state, in accordance with an embodiment of the present invention.

FIG. 1 depicts a perspective view of a system 100 including a stabilization device 104 coupled to a firearm 108 to facilitate the stabilized discharge of the firearm 108 in accordance with an embodiment of the present invention. The stabilization device 104 may have two legs 112 and may, in this instance, be referred to as a bipod. In other embodiments, the stabilization device 104 may have one leg, i.e., monopod, or more than two legs, e.g., tripod or polypod.

In one embodiment, the stabilization device 104 may include a mount 116 to couple to a fore-end 120 of a stock of the firearm 108, as shown in FIG. 1. The mount 116 may have a surface that is contoured in a manner to complement the coupling surface of the firearm 108, e.g., the portion of the fore-end 120 that the mount 116 is coupled to. In another embodiment, the mount 116 may be coupled to the barrel 124 of the firearm 108. In one embodiment the mount 116 may be coupled to the fore-end 120 by a bolt that may also serve as an attachment point for a sling.

FIG. 1 illustrates the stabilization device 104 being in a stored state. In the stored state, the stabilization device 104 may be disposed in a manner that positions the legs 112 substantially parallel to one another and to the mounting surface of the mount 116. With the stabilization device 104 so disposed, the legs 112 may be adjacent to the barrel 124, as shown in FIG. 1. This design may allow for the stabilization device 104 to be substantially within the outer profile dimensions of the firearm 108, e.g., defined by a line from the butt of the grip to the end of the barrel, while in the stored state.

This may in turn facilitate the portability of the system 100 in accordance with an embodiment of the present invention.

Figure 2:
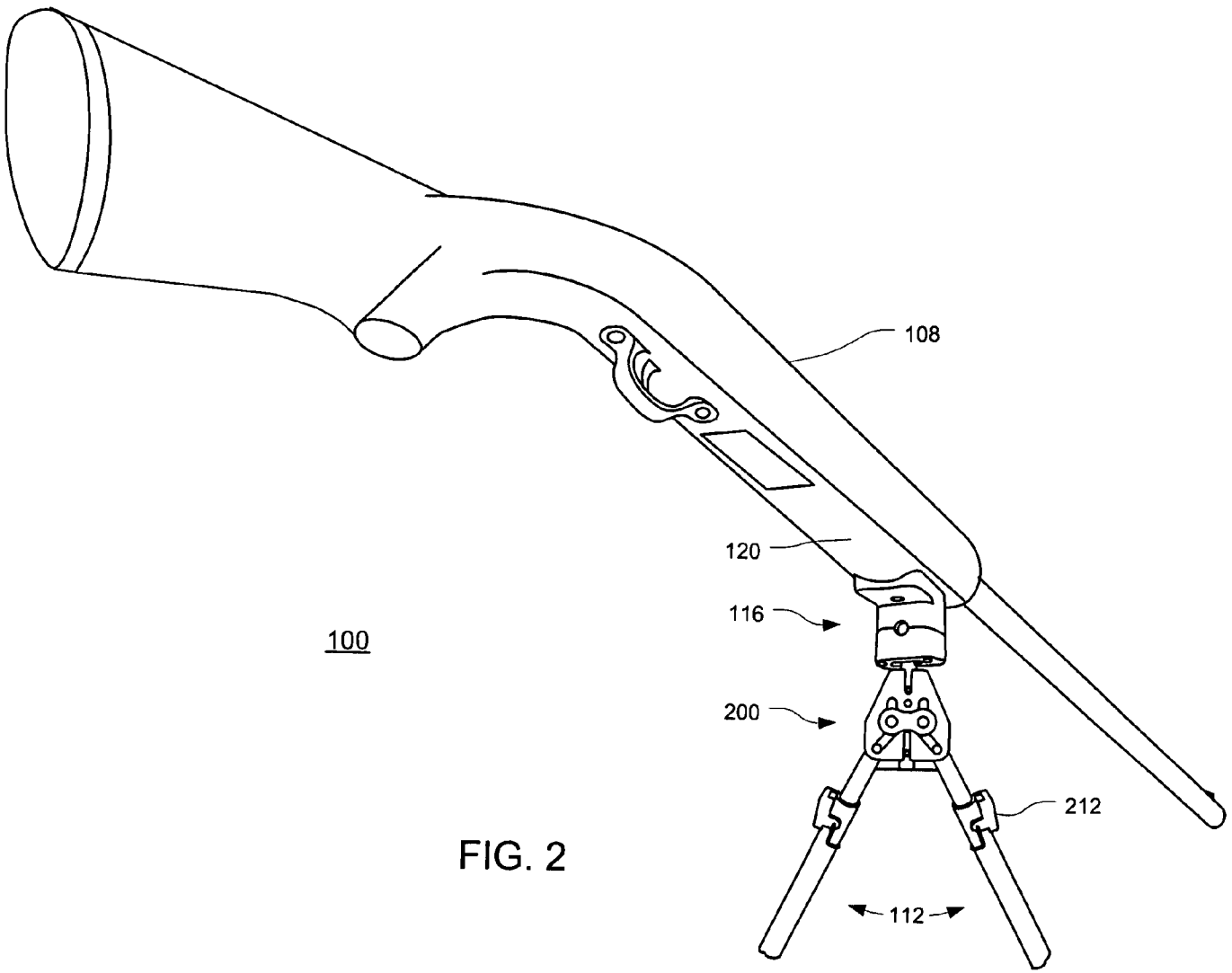
FIG. 2 illustrates a perspective view of the system with the stabilization device in a deployed state, in accordance with an embodiment of the present invention.

The stabilization device 104 may have a deployment mechanism that allows the stabilization device 104 to transition between the stored state, illustrated in FIG. 1, and the deployed state, illustrated in FIG. 2, in accordance with an embodiment of the present invention. The deployment mechanism, which will be described later in further detail, may be easily accomplished with one hand, allowing the operator to hold the firearm 108 with the other.

The deployed state of the stabilization device 104 illustrated in FIG. 2 may orient a head unit 200 substantially orthogonal to the mounting surface of the mount 116. Additionally, the illustrated deployed state shows that the legs 112 may be in a splayed position while in the deployed state. This splayed position of the legs 112 may allow them to contact a supporting surface in a manner to steadily transfer at least a portion of the weight of the firearm 108 to the supporting surface. The support provided by the stabilization device 104 may be used to facilitate the aiming and subsequent discharge of the firearm 108. In various embodiments, the legs 112 may have adjustable lengths to accommodate the orientation of the operator, e.g., prone, kneel, or upright, as well as the topography of the terrain that is used as a supporting surface. In one embodiment, the legs 112 may be adjustable through, e.g., a telescoping manner. For example, in one embodiment the legs 112 may each have an upper leg 204 disposed within a lower leg 208. The upper and lower legs may be secured relative to one another at a desired height. In one embodiment the upper and lower legs may be secured to each other by latches 212. In other embodiments the legs 112 may have adjustable heights through other telescoping and non-telescoping manners.

In various embodiments, the firearm 108 may be any type of device adapted to propel a projectile with a high velocity. In one embodiment, the propulsion force may be provided by deflagration caused by an incendiary such as, e.g., gunpowder. However, the firearm 108 is not so limited in other embodiments. For example, in another embodiment, the propulsion force may be applied to the projectile through gas pressure. Therefore, in various embodiments the firearm 108 may be, but is not limited to, a rifle, a gun, a pistol, or an air gun. The system 100 may be used in a number of applications including, but not limited to, police and military uses, hunting, or gaming (e.g., paintball).

Figure 3:
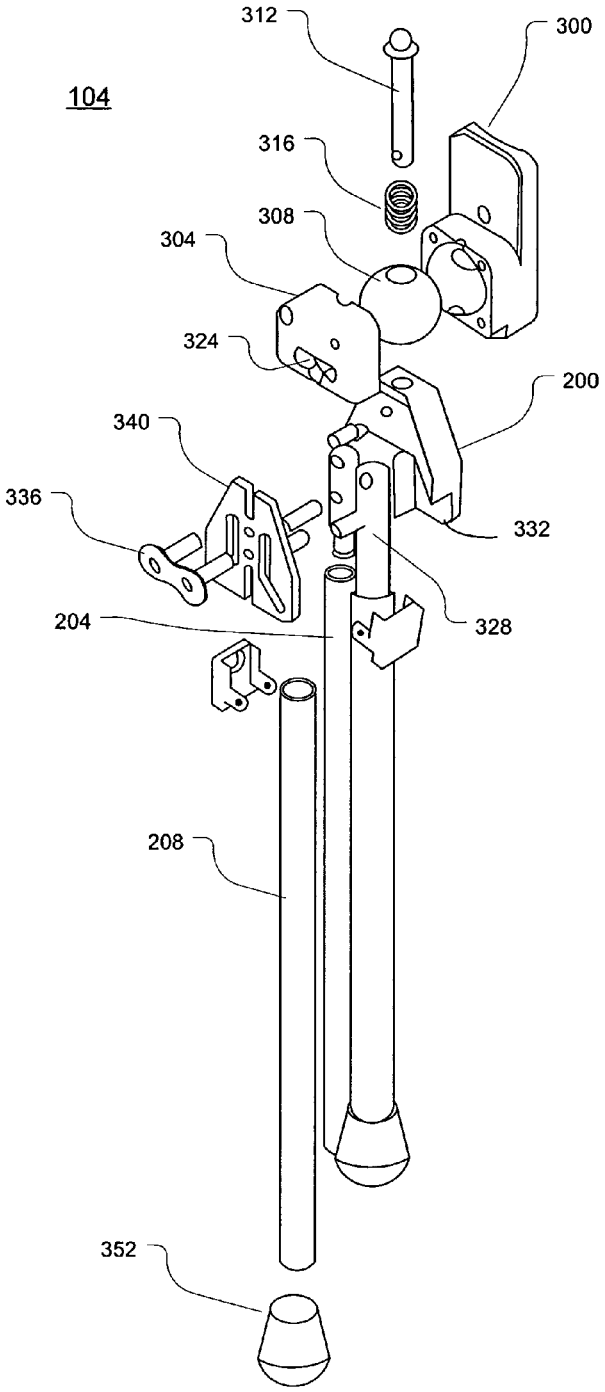
FIG. 3 illustrates a partially exploded perspective view of the stabilization device, in accordance with an embodiment of the present invention.
Figure 4:
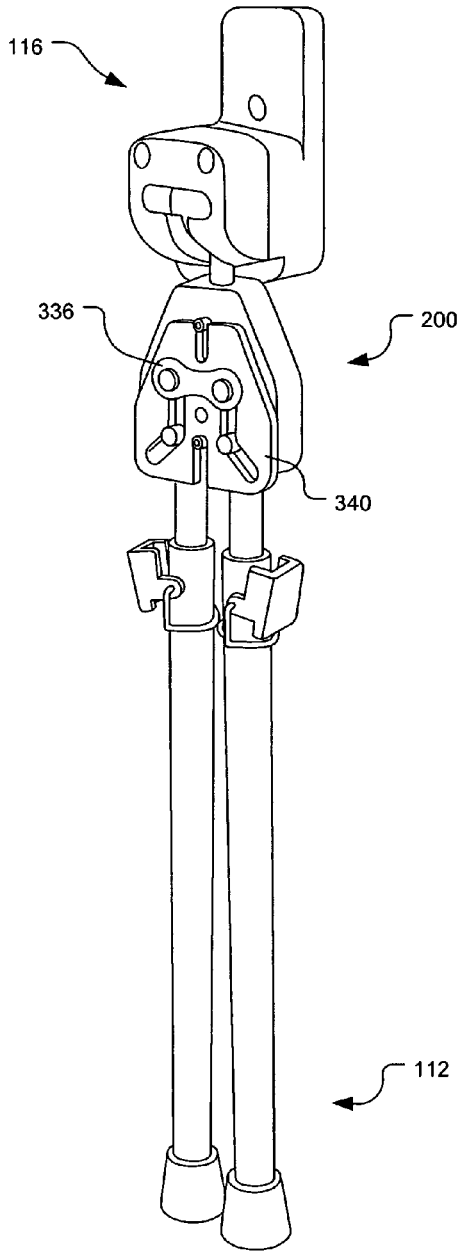
FIG. 4 illustrates an assembled perspective view of the stabilization device, in accordance with an embodiment of the present invention.

FIGS. 3-4 respectively illustrate partially-exploded and assembled perspective views of the stabilization device 104, in accordance with an embodiment of the present invention. The mount 116 may include a mount base 300 that is coupled to a mount cap 304 with a ball 308 disposed in between. The mount base 300 may be coupled to the mount cap 304 by screws, bolts, snaps, or some other securing mechanism. The ball 308 may be hollow so that a head pin 312 may be disposed through the ball 308 and a spring 316, wrapped around the head pin 312, may be disposed inside of the ball 308.

The mount 116 may be coupled to the head unit 200 by the head pin 312. In one embodiment, the head pin 312 may have male threads on a first end that screw directly into a female threaded hole in the head unit 200. In another embodiment, the head pin 312 may be inserted into a hole of the head unit 200 and secured by a cross pin.

The cap 304 may have a cutout 324 adapted to provide the head pin 312 a path for transitioning the head unit 200 between the stored and deployed states. In one embodiment the cutout 324 may also include a cross path that may allow for the mount 116, and firearm 108, to tilt a certain amount back and forth while the head unit 200 is in the deployed state. This tilt range may be up to, e.g., ±25 degrees.

In one embodiment, leg tops 328 may be pivotally coupled to the head unit 200. The head unit 200 may have a recess 332 designed to allow the leg tops 328 to rotate between parallel and splayed positions. The leg tops 328 may be pivotally coupled to the head unit 200 by a connecting link 336 that also couples a cam plate 340 to the head unit 200. In one embodiment the connecting link 336 may be disposed through the head unit 200 and secured with a retainer (not shown) on the opposite side of the head unit 200. The cam plate 340 may be coupled to the head unit 200 in a manner that allows linear motion between the two components, to be discussed in further detail later. One or more cam guide pins 344 may be coupled to the head unit 200 and engage tracks of the cam plate 340 to facilitate this linear motion. The leg tops 328 may also have guide pins 348 to engage tracks of the cam plate 340.

In one embodiment, leg tops 328 may be compression fit into cavities of the legs 112. Other embodiments may employ other coupling mechanisms such as, but not limited to, screw tops. In still other embodiments, the legs tops 328 may be part of the legs 112 themselves. The distal end of the legs 112 may be fit with leg tips 352. In one embodiment, the tips 352 may be a rubber material that is designed to provide traction with the supporting surface. In another embodiment the legs 112 may be fit with plugs.

Figure 5:
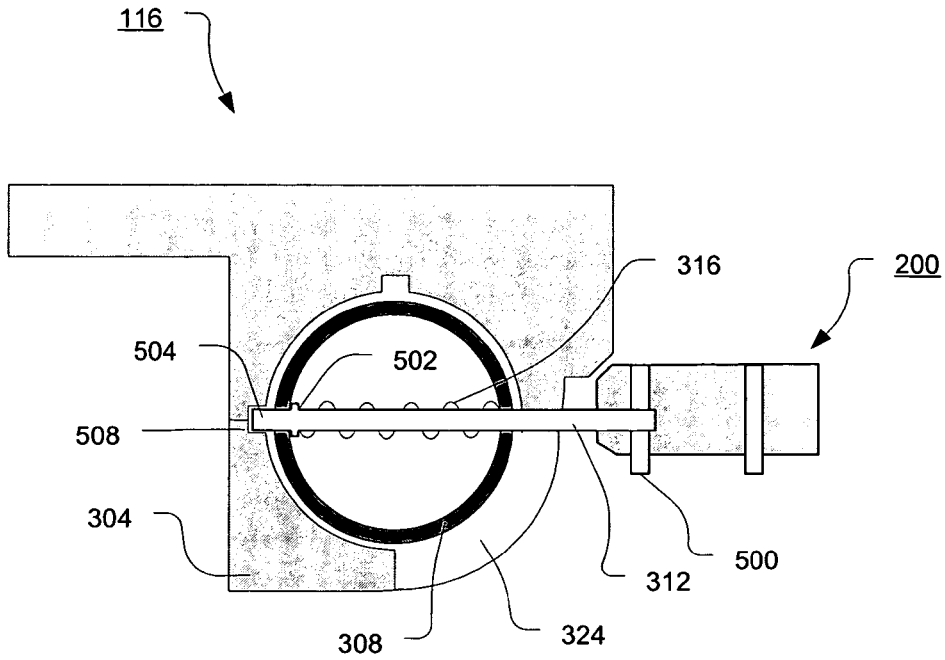
FIG. 5 illustrates a cross-sectional view of a head unit coupled to the mount in the stored state, in accordance with an embodiment of the present invention.

FIG. 5 illustrates a cross-sectional view of the head unit 200 coupled to the mount 116 in the stored position in accordance with an embodiment of the present invention. In this embodiment, the head pin 312 is coupled to the head unit 200 by a cross pin 500 that may also serve as a guide pin 344. The head pin 312 may be disposed through the ball 308. The spring 316 may be wrapped around the head pin 312 and may exert a spring force against the interior of ball 308 and the head pin 312. In one embodiment, the head pin 312 may include a collar 502 to control the amount the end 504 that is exposed beyond the ball 308 and to provide a surface for the spring 316 to press against. The spring force may cause the head pin 312 to engage the mount 116. The head pin 312 may engage the mount 116 by having a first end 504 at least partially disposed within a recess 508. The recess 508 of this embodiment may be formed by complementary cutouts of the base 300 and the cap 304. In various embodiments, the recess 508 may be an indention in the interior wall of the mount 116, or alternatively, may be a through-hole.

In one embodiment, the head pin 312 may be disengaged from the mount 116 by exerting a transitional force on the head pin 312 in a direction away from the mount 116 to overcome the spring force of the spring 316. This transitional force may be exerted by an operator pulling on the head unit 200. With the end 504 retracted from the recess 508 the head unit 200 may transition from the stored state shown in FIG. 5 to the deployed state shown in FIG. 6, in accordance with an embodiment of the present invention. In transition between the two states, the portion of the head pin 312 that is between the ball 308 and the head unit 200 may travel along the cutout 324 of the cap 304.

Figure 6:
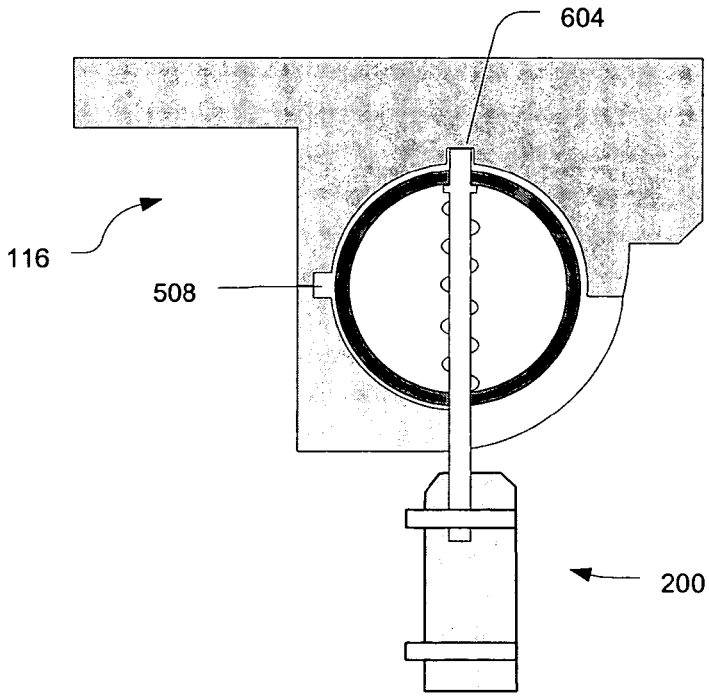
FIG. 6 illustrates a cross-sectional view of the head unit coupled to the mount in the deployed state, in accordance with an embodiment of the present invention.

When the head unit 200 is fully transitioned to the deployed state, illustrated in FIG. 6, and the transitional force is removed, the spring force may cause the head pin 312 to reengage the mount 116 by having the end 504 become at least partially disposed within a recess 604. In an embodiment where the cutout 324 accommodates tilting of the mount 116 while the head unit 200 is in the deployed state, the recess 604 may have a complementary path to allow the end 504 to travel back and forth without the head pin 312 disengaging the mount 116. In various embodiments, the recess 604 may be an indention in the interior wall of the mount 116 (and more particularly the base 300), it may be a through-hole, or some combination of the two.

Figure 7:
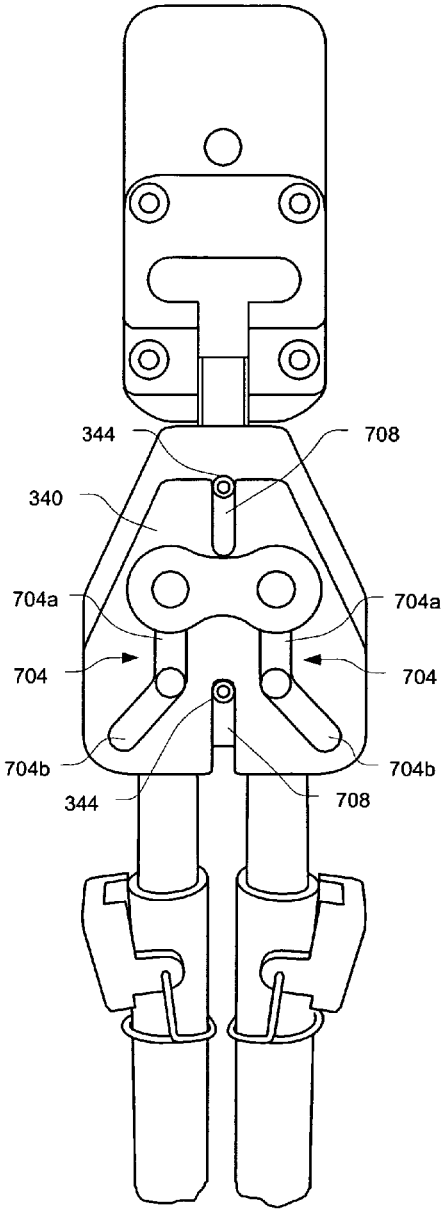
FIG. 7 illustrates a front view of various components of the stabilization device with the legs being in a stored position, in accordance with an embodiment of the present invention.

FIG. 7 illustrates a front view of various components of the stabilization device 104 with the legs 112 being in a stored position, in accordance with an embodiment of the present invention. In this embodiment, the cam plate 340 may have tracks 704. The tracks 704 may each have two portions, e.g., a link-pin portion 704*a* for the pins of the connecting link 336, and a leg-pin portion 704*b* for the leg-top pins 348. While the legs 112 are in the stored position the leg-top pins 348 may be at the interface of the link-pin portion 704*a* and the leg-pin portion 704*b*.

In an embodiment the cam plate 340 may also have two guide pin tracks 708 in which the guide pins 344 are disposed. The guide pins 344, guide pin tracks 708, connecting link 336, and tracks 704 may all cooperate to provide a delineated path for relative linear motion between the cam plate 340 and the head unit 200.

Figure 8:
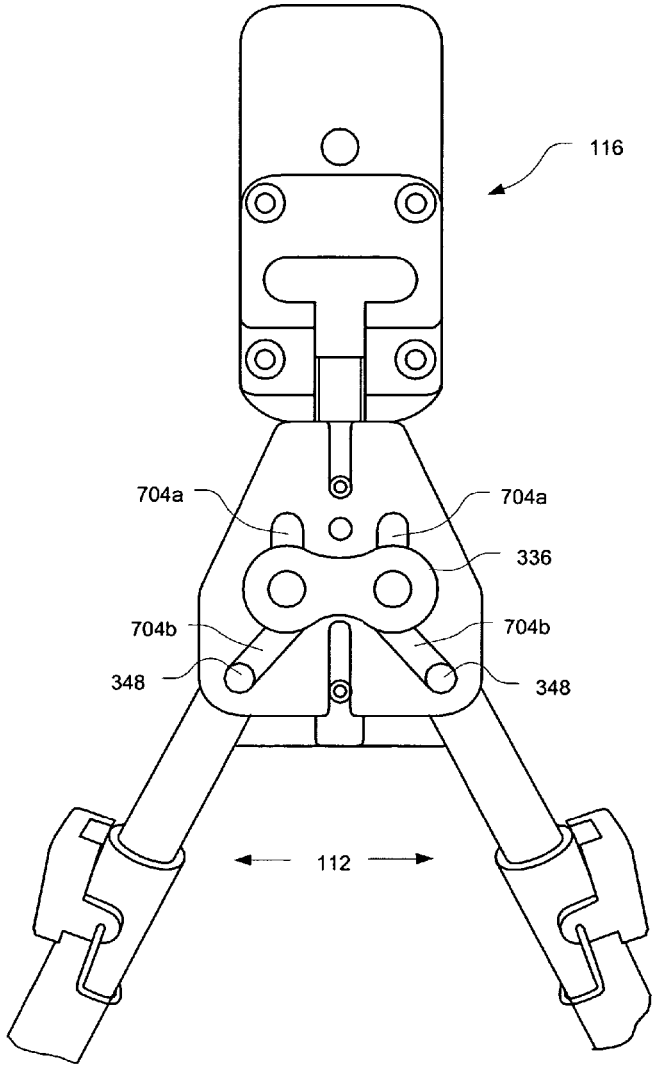
FIG. 8 illustrates a front view of the various components of the stabilization device with the legs being in the deployed position, in accordance with an embodiment of the present invention.

In one embodiment the two tracks 704 may be substantially symmetrical to one another. In this embodiment, the leg-pin portions 704*b* and the leg-top pins 348 may cooperate in a manner to provide even deployment of the leg tops 328 from the substantially parallel position shown in FIG. 7 to the splayed position shown in FIG. 8. As one of the legs 112 is outwardly rotated the cam plate 340 will travel upward relative to the head unit 200 causing the other leg 112 to rotate outward in a similar manner as the leg-top pins 348 travel through the leg-pin portions 704*b* of the tracks 704. In this manner, the steady and even deployment of the legs 112 may result without the need for any springs. This may facilitate repetitive and reliable deployment of the legs 112 without relying on exposed springs.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. A stabilization device comprising: a head unit; a cam plate coupled to the head unit, having a first track and a second track; a first leg top coupled to the head unit having a first pin to engage the first track; and a second leg top coupled to the head unit having a second pin to engage the second track, wherein the cam plate is coupled to the head unit in a manner to facilitate linear motion of the cam plate relative to the head unit, and wherein the cam plate further includes a third and a fourth track and the stabilization device further comprises: a third and a fourth pin coupled to the head unit and adapted to engage the third and fourth tracks of the cam plate, respectively, the third and fourth pins to facilitate the relative linear motion of the cam plate, and further comprising: a connecting link adapted to couple the cam plate to the head unit through the first and second tracks and further adapted to couple the first and second leg tops to the head unit in a manner to allow at least one of the first and second leg tops to rotate between a first and a second position.

2. The stabilization device of claim 1, wherein at least one of the first and second tracks include a first path to facilitate the relative linear motion of the cam plate; and a second path to facilitate the transition of the at least one leg top between the first and second positions.

3. The stabilization device of claim 1 wherein the first and second tracks are substantially symmetrical.

4. The stabilization device of claim 1, further comprising: a mount adapted to be coupled to a firearm, and further adapted to be coupled to the head unit in a manner to facilitate the head unit to be disposed in a first state or a second state.

5. The stabilization device of claim 4, wherein the mount further comprises: a ball coupled to the head unit by a head pin in a manner to facilitate the head unit to transition between the first state and the second state.

6. A system comprising: a firearm; and a stabilization device coupled to the firearm, the stabilization device having a head unit; a cam plate coupled to the head unit, having a first track and a second track; a first leg top coupled to the head unit having a first pin to engage the first track; and a second leg top coupled to the head unit having a second pin to engage the second track, wherein the cam plate is coupled to the head unit in a manner to facilitate linear motion of the cam plate relative to the head unit, and wherein the cam plate further includes a third and a fourth track and the stabilization device further comprises: a third and a fourth pin coupled to the head unit and adapted to engage the third and fourth tracks of the cam plate, respectively, the third and fourth pins to facilitate the relative linear motion of the cam plate, and further comprising: a connecting link adapted to couple the cam plate to the head unit through the first and second tracks and further adapted to couple the first and second leg tops to the head unit in a manner to allow at least one of the first and second leg tops to rotate between a first and a second position.

7. The system of claim 6, wherein the stabilization device further comprises: a mount coupled to the firearm and the head unit, the mount coupled to the head unit in a manner to facilitate the head unit to be disposed in a first state or a second state.

8. The system of claim 7, wherein the mount further comprises: a ball coupled to the head unit by a head pin in a manner to facilitate the head unit to transition between the first state and the second state.

9. The system of claim 7, wherein the firearm comprises a rifle or an air gun.

* * * * *